US006997112B2

(12) United States Patent
Nishizaki et al.

(10) Patent No.: US 6,997,112 B2
(45) Date of Patent: Feb. 14, 2006

(54) CARGO HANDLING PALLET

(75) Inventors: Hideaki Nishizaki, Higashiosaka (JP); Toshio Takagi, Hiratsuka (JP)

(73) Assignee: Shin-Ei Kamishoko Co., Ltd., Osaka (JP)

( * ) Notice: Subject to any disclaimer, the term of this patent is extended or adjusted under 35 U.S.C. 154(b) by 0 days.

(21) Appl. No.: 10/495,179

(22) PCT Filed: Nov. 10, 2002

(86) PCT No.: PCT/JP02/10583

§ 371 (c)(1),
(2), (4) Date: May 11, 2004

(87) PCT Pub. No.: WO03/043892

PCT Pub. Date: May 30, 2003

(65) Prior Publication Data

US 2005/0011418 A1 Jan. 20, 2005

(30) Foreign Application Priority Data

Nov. 19, 2001 (JP) ..... 2001-352784

(51) Int. Cl.
*B65D 19/00* (2006.01)

(52) U.S. Cl. ..... 108/51.3; 108/57.17

(58) Field of Classification Search ..... 108/51.3, 108/56.1, 56.3, 57.17

See application file for complete search history.

(56) References Cited

U.S. PATENT DOCUMENTS

| | | | | | |
|---|---|---|---|---|---|
| 4,863,024 | A | * | 9/1989 | Booth | 108/51.3 |
| 5,487,345 | A | * | 1/1996 | Winebarger et al. | 108/51.3 |
| 5,493,962 | A | * | 2/1996 | McCarthy | 108/51.3 |
| 5,528,994 | A | * | 6/1996 | Iseli | 108/51.3 |
| 5,537,935 | A | * | 7/1996 | Otaguchi et al. | 108/51.3 |
| 5,685,234 | A | * | 11/1997 | Grigsby et al. | 108/51.3 |
| 5,941,177 | A | * | 8/1999 | Anderson | 108/51.3 |
| 6,095,061 | A | * | 8/2000 | Perazzo | 108/51.3 |
| 2001/0025589 | A1 | * | 10/2001 | Moberg | 108/51.3 |

FOREIGN PATENT DOCUMENTS

| | | | | |
|---|---|---|---|---|
| JP | 55-61531 U | | 4/1980 | |
| JP | 61-35139 A | | 3/1986 | |
| JP | 06239345 | * | 8/1994 | 108/51.3 |
| JP | 6-80632 U | | 11/1994 | |

* cited by examiner

*Primary Examiner*—Lanna Mai
*Assistant Examiner*—Hanh V. Tran
(74) *Attorney, Agent, or Firm*—Pearne & Gordon LLP

(57) ABSTRACT

A cargo pallet has a framework including a plurality of beams that are each formed of a square hollow body of paperboard treated for water resistance and water repellency. Each beam is engaged at a predetermined distance with and adhered to a pair of channel-shaped bent edge members of paperboard material faced to each other. Strip-like boards are placed in parallel to each other on both the front and back faces of the beams with a gap provided between adjacent strip-like boards in a direction perpendicular to the beam length and adhered to the beams. Each of the strip-like boards is formed with a pattern paper treated for water resistance and water repellency that covers all of the periphery of front and back faces of an inner core member of thick paperboard. Fork insertion openings are provided in the edge members having paperboard reinforcing layers.

5 Claims, 12 Drawing Sheets

CARGO HANDLING PALLET

TECHNICAL FIELD

This invention relates to a pallet made of paperboard used for storing cargoes or loading and unloading them.

BACKGROUND OF THE INVENTION

A pallet has been broadly used for storing cargoes in factories or in physical distribution industries or for effectively conveying cargoes in collection and delivery business. Such a pallet has been of dual plug type in which two forks of a forklift truck or stacker can be inserted into the pallet and has been mainly made of wood or metal. A flat pallet has a size of 1100×1100 mm and is specified as JISZ060 and called TII type.

There has been also a pallet made of resin, but the resin pallet has a high weight and an expensive cost and therefore it is hard to distribute it. Thus, the resin pallet has been used just in some fields in which water is used and there has been mainly used the wooden or metallic pallet as aforementioned. However, the wooden pallet is remarkably broken so as to be split due to knots, bending or twisting of wood because most wood used might be of imported wood or of fraction material of lumber and therefore it has been disposed of after it was reciprocally used two or three times. Accordingly, the wooden pallet is undesirable in view of natural resources and in view of cost and not suitable for recycling. The metallic pallet is advantageous in strength, but undesirable for cost. In addition thereto, both of the wooden and metallic pallets have weight and therefore inconvenient for handling. There have been proposed pallets of corrugated paper or pasteboard and beam material used for the pallets, which can avoid the problems of the resin, wooden and metallic pallets.

The beam material has a complicated construction in which reinforcement pieces are provided in front and back sides of spaces between adjacent two square hollow bodies or a space between two square hollow bodies are filled with many reinforcement boards without any crevice. The pallet has a construction in which, a plurality of beam materials having the aforementioned two square hollow bodies as a single body are laterally inserted between upper and lower decks having both side faces.

In the aforementioned beam materials, a sheet of board material has many slits and folding lines formed provided. The square hollow body is formed by bending the board material, the reinforcement piece is formed by folding up the board material and many reinforcement boards are inserted into the space between the two square hollow bodies. Thus, there is required a step to form many slits and folding lines at many places of the board material of the beam. Meantime, there is required a step to cut the reinforcement boards to the size according to the space between the square hollow bodies in the beam material having many reinforcement boards inserted within the space between the square hollow bodies. There is also required an operation to assemble the beam materials by bending or folding up or to insert many reinforcement boards within the space. Furthermore, the board material having a larger area is required for forming the two square hollow bodies from a sheet of paperboard and many board materials are required for forming many reinforcement boards, which causes the high manufacture cost of the beam material. Especially, the beam material having the construction in which many reinforcement boards are inserted within the space has an increased weight and in addition thereto, a complicated construction. Thus, it can never be expected that the beam material has a lightweight turned due to its complicated construction.

The aforementioned pallet is required to have the paperboard material having an area enough to form the upper and lower decks including both sides. The beam materials to be inserted between the upper and lower decks in a lateral direction so as to support almost the area of the upper and lower decks are formed of the two longer square hollow bodies and there are used a plurality of beam materials having the two square hollow bodies as a single body. This disadvantageously causes the weight of the pallet to never get lower and also the cost thereof to be higher. Furthermore, such a pallet of paperboard is required to have enough durability maintained not only in case where it is used in a watering place, but also in case where it is used in an atmosphere of high humidity in a rainy season or like. In addition thereto, the pallet is required to have strength and rigidity maintained because pallet portions where the fork insertion openings are provided tend to be deformed or damaged due to a larger concentrated load applied to such pallet portions when the pallet is supplied by inserting the fork into the respective insertion openings. However, the conventional pallets of paperboard have not taken into consideration of these requirements and therefore they have been broken at an early stage and have had poor durability.

DISCLOSURE OF THE INVENTION

In view of such technical problems, this invention provides a cargo handling (loading and unloading) pallet of paperboard material adapted to be more easily manufactured and constructed and to have lightweight, high strength, water resistance, humidity resistance and durability and is suitable for recycling so as to be protective to earth environment whereby it is safe and economically useful.

This invention is characterized by comprising a framework having a pair of channel-shaped elongated bended edge members of paperboard material faced to each other and a plurality of beams of square hollow body of paperboard material treated for water resistance and water repellency, having both ends engaged with the bended edge members in a manner perpendicular to a longitudinal direction of the bended edge members and placed in parallel to each other in a manner spaced at predetermined distance whereby forks of a forklift truck, a stacker or the like can be inserted between them; and strip-like boards placed in parallel to each other on both or either of front and back faces of the beams with a gap provided between adjacent strip-like boards in a direction perpendicular to a longitudinal of the beams and adhered to the beams, each of the strip-like boards formed of an inner core member of thick paperboard such as solid board and a pattern paper treated for water resistance and for water repellency and covering all the periphery of front and back faces of the inner core member and each of the strip-like boards being treated by coating agent for water resistance and for water repellency, the bended edge members having a pair of fork insertion openings provided in a vertical wall face thereof and having paperboard layers bended and superposed one on another so as to reinforce upper and lower faces of portions where the fork insertion openings are provided.

The invention is also characterized by comprising a framework having a pair of channel-shaped elongated bended edge members of paperboard material faced to each other and a plurality of beams of square hollow body of paperboard material treated for water resistance and for water repellency, having both ends engaged with the bended edge members in a manner perpendicular to a longitudinal direction of the bended edge members and placed in parallel to each other in a manner spaced at predetermined distance whereby a fork of a forklift truck, a stacker or the like can be inserted between them; and strip-like boards placed in parallel to each other on both or either of front and back faces of the beams with a gap provided between adjacent strip-like boards in a direction perpendicular to a longitudinal of the beams and adhered to the beams, each of the strip-like boards formed of an inner core member of thick paperboard such as solid board and a pattern paper treated for water resistance and for water repellency and covering all the periphery of front and back faces of the inner core member and each of the strip-like boards being treated by coating agent for water resistance and for water repellency; the bended edge members having a pair of fork insertion openings provided in a vertical wall face thereof and having a reinforcement member of paperboard adhered to upper and lower faces of the bended edge members to reinforce upper and lower faces of portions where the fork insertion openings are provided.

The invention is further characterized by comprising a top board of paperboard having channel-like bend portions elongated in a lateral direction and faced to each other in two faced sides of square or a bottom board following the bend portions; and beams of square hollow body of paperboard placed in a direction perpendicular to a longitudinal direction of the bend portions and having both ends engaged with and adhered to the bend portions; the bend portions having a pair of fork insertion openings provided in a vertical wall face thereof and having a reinforcement frame member of paperboard adhered to the bend portions to reinforce the bend portions where the fork insertion openings are provided and beams provided at places of the bend portions where the fork insertion openings are not provided along a longitudinal direction of the bend portions.

The invention is further characterized by comprising a framework having a pair of channel-shaped elongated bended edge members of paperboard material faced to each other and a plurality of beams of paperboard material treated for water resistance and for water repellency, having both ends engaged with the bended edge members in a manner perpendicular to a longitudinal direction of the bended edge members and placed in parallel to each other in a manner spaced at predetermined distance whereby a fork of a forklift truck, a stacker or the like can be inserted between them; the beam having a framework formed by cutting at predetermined distance an assembly of a plurality of elongated square hollow bodies placed in parallel to each other at predetermined distance and a flat board of paperboard material adhered to upper and lower faces of the square hollow bodies; the step of cutting being performed in a direction perpendicular to a longitudinal direction of the square hollow bodies and the thus formed framework having a plurality of square poles disposed between upper and lower strip-like boards; the beam further having an outer board of paperboard with which the framework is covered on four faces of the periphery thereof, and the pallet further comprising a flat board adhered to both or either of front and back faces of the beams so as to form a top board and/or a bottom board.

The invention is characterized in that the just aforementioned outer board surrounding the beam framework has fork insertion openings provided therein for a forklift truck or a stacker.

BEST MODE OF CARRYING OUT THE INVENTION

Some embodiments of the invention will be described with reference to the accompanying drawings.

(Embodiment 1)

Figure 1:
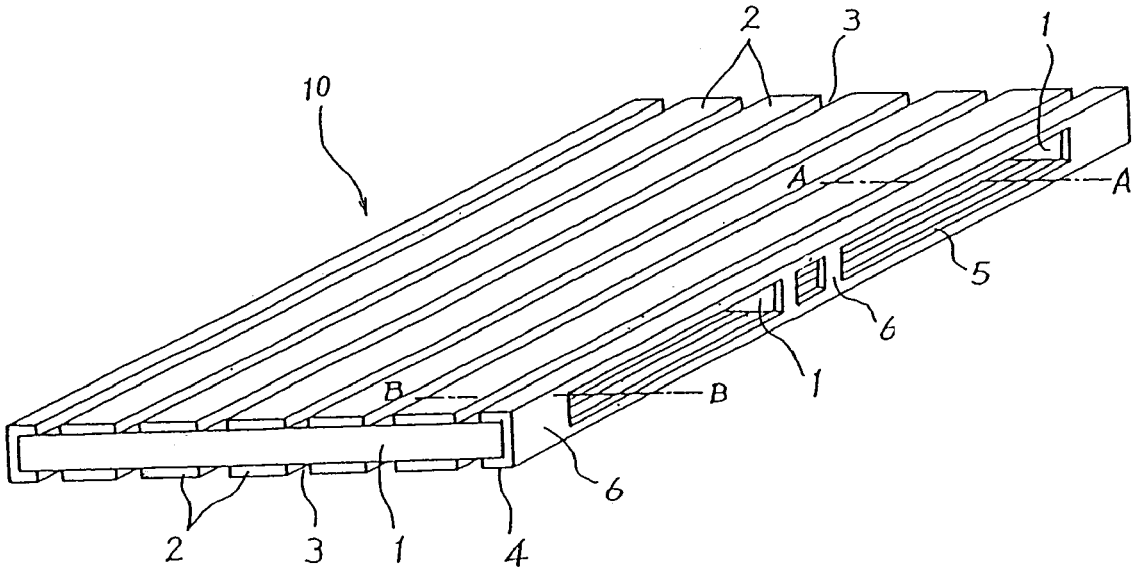
FIG. 1 is a perspective view of a pallet constructed in accordance with the invention.
Figure 2:
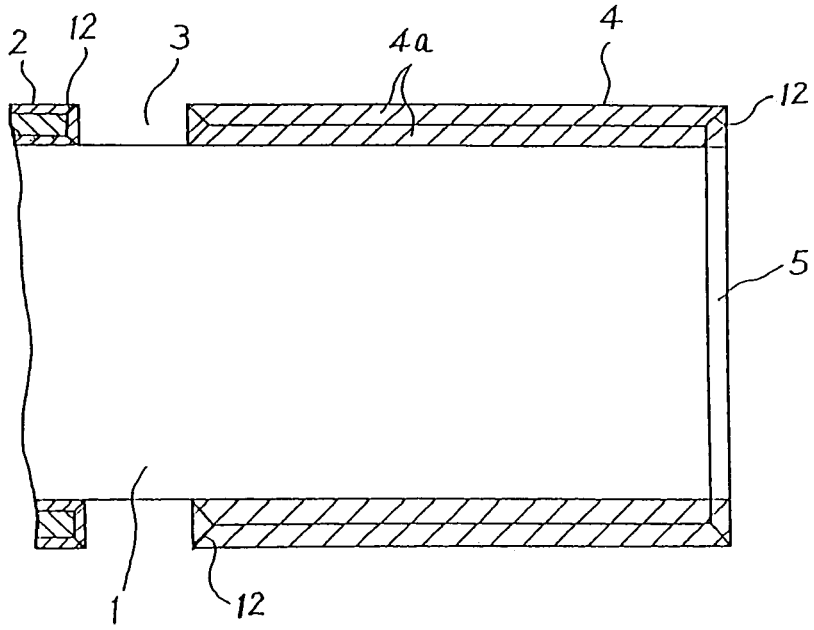
FIG. 2 is a cross sectional view of the pallet taken along a line A—A of FIG. 1.
Figure 3:
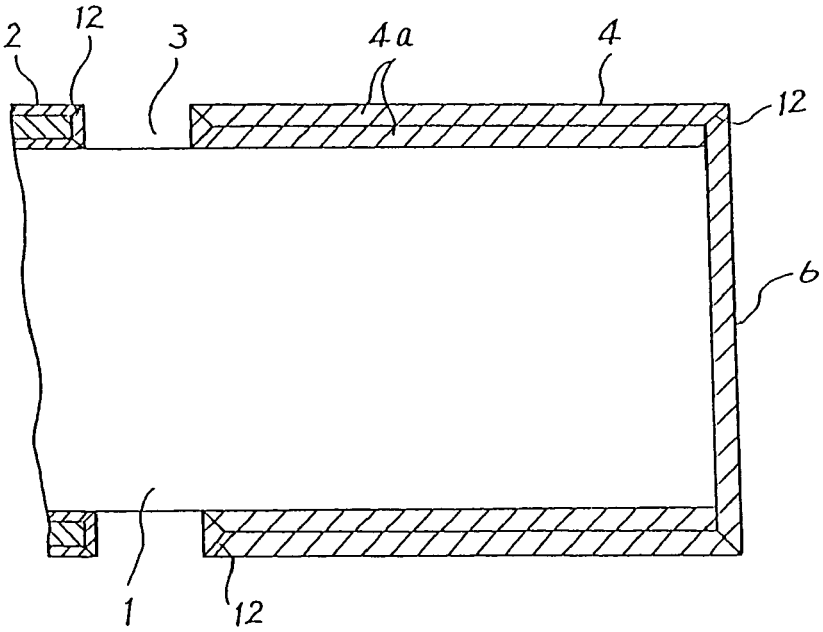
FIG. 3 is a cross sectional view of the pallet taken along a line B—B of FIG. 1.
Figure 4:
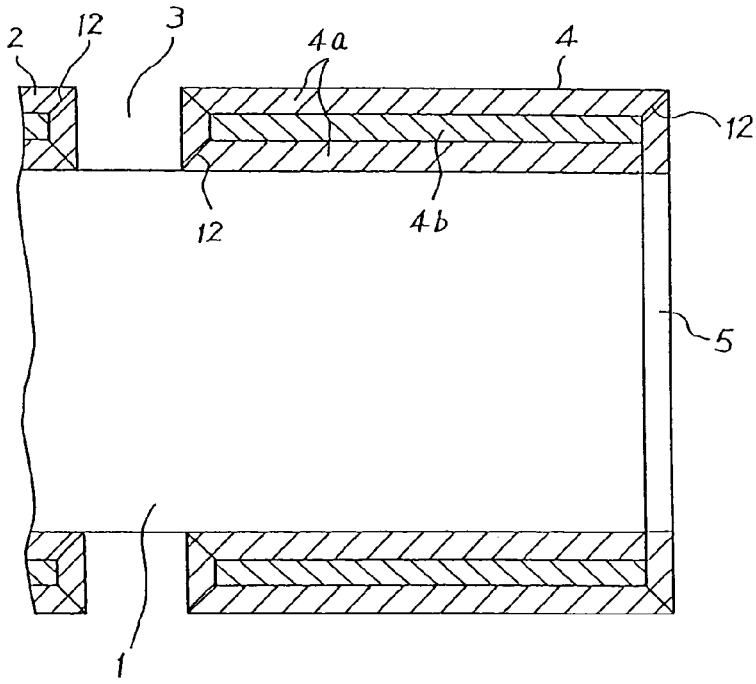
FIG. 4 is a cross sectional view of a pallet in accordance with another embodiment of the invention as taken along a line A—A of FIG. 1.
Figure 5:
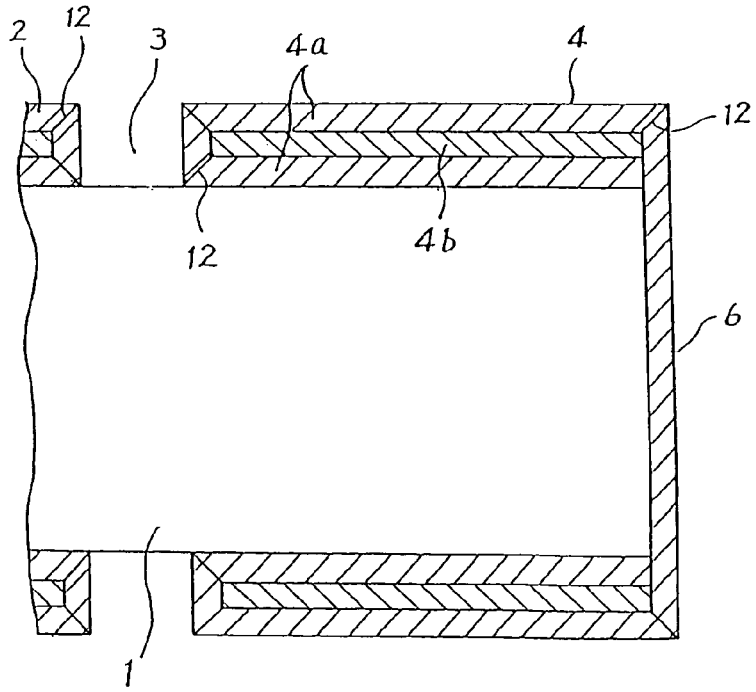
FIG. 5 is a cross sectional view of the pallet corresponding to that of FIG. 4 as taken along a line B—B of FIG. 1.

In FIG. 1, a reference numeral 10 designates a cargo handling (loading and unloading) pallet having the form of drainboard constructed in accordance with the invention. A reference numeral 4 designates a pair of individual elongated channel type bended edge members formed of paperboard faced to each other. As shown in FIGS. 2 and 3, upper and lower sides of the bended edge members comprise two layers 4*a* formed by bending paperboard materials of predetermined thickness along a V-cut groove 12 and superposing one upon another so as to have strength and rigidity and being surface-treated by coating for imparting water resistance and water repellent property to the layers 4*a*. The bended edge members 4 have a pair of right and left fork insertion openings 5 provided in their vertical wall face 6 thereof The portions where the fork insertion openings 5 are provided can have the strength and the rigidity against raising up by forks, maintained by means of the upper and lower layers 4*a*. In case where the strength and the rigidity of the upper and lower faces of the bended edge members 4 should further increase, the upper and lower sides may be formed of three layers having an inner core material 4*b* disposed between the two layers 4*a* so as to increase the thickness thereof. A hole 13 may be provided in a center portion of the bended edge members 4 in a longitudinal direction for inserting a cargo binding band.

A reference numeral 1 designates a plurality of beams in the form of square hollow body made of paperboard material. The beam members 1 at both ends are inserted into the bended edge members 4 at portions excluding the fork insertion openings 5 in a manner spaced at predetermined distance in parallel to each other in a longitudinal direction so that a fork of a forklift truck, a stacker or the like and securely bonded by adhesives to the vertical wall face 6 to thereby form a frame of the pallet in an integral manner. A reference numeral 2 designates a plurality of strip-like board (divisional boards of the drainboard). These strip-like boards may be adhered to either of the front and back faces of the beams 1 in a manner parallel to each other with a gap 3 provided between the adjacent beams 1 in a manner perpendicular to the longitudinal direction of the beams 1.

Figure 6:
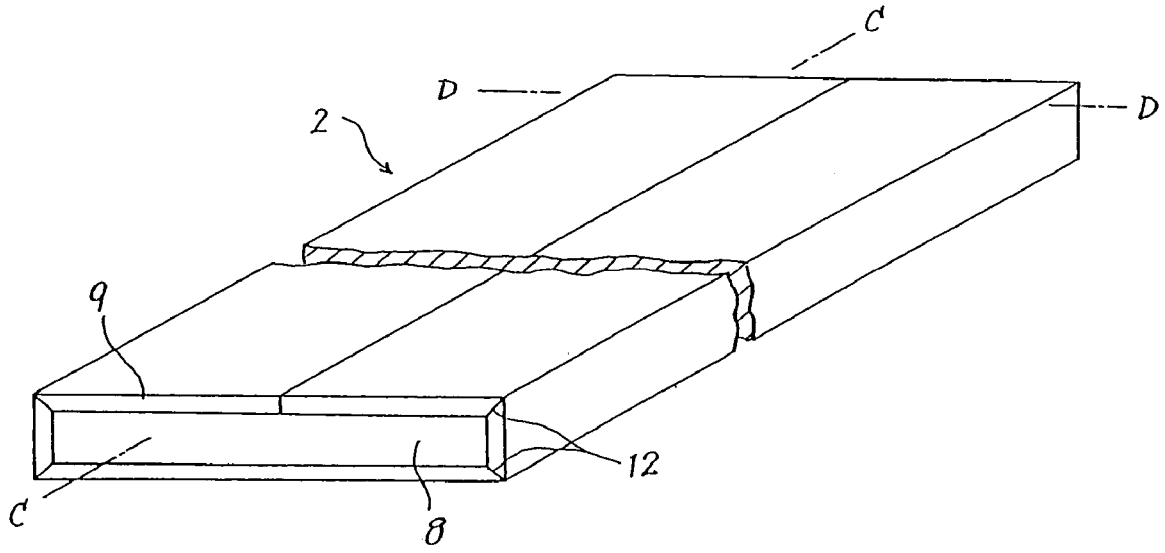
FIG. 6 is a perspective view of a strip-like board.
Figure 7:
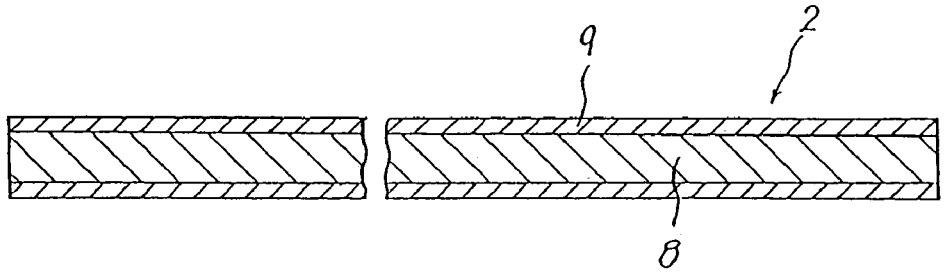
FIG. 7 is a cross sectional view of the board of FIG. 6 taken along a line C—C of FIG. 6.
Figure 8:
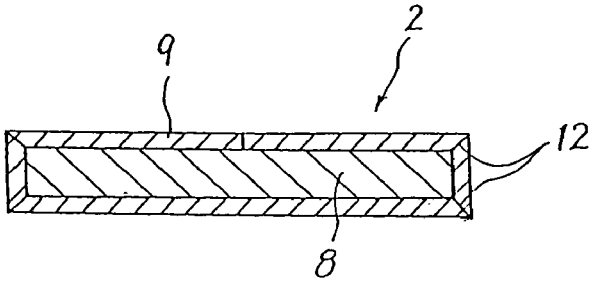
FIG. 8 is a cross sectional view of the board of FIG. 6 taken along a line D—D of FIG. 6.

As shown in FIGS. 6 through 8, the strip-like boards 2 are so constructed as to have an inner core material 8 of paperboard such as solid board and a pattern paper layer 9 with which the inner core material 8 is covered all over the surfaces thereof. The pattern paper layer 9 is treated for imparting water resistance and water repellency thereto. The pattern paper layer 9 has V-cut grooves 12 provided at its bended portions to be able to be bended at right angle in the sides of the inner core material so as to surround it.

Figure 9:
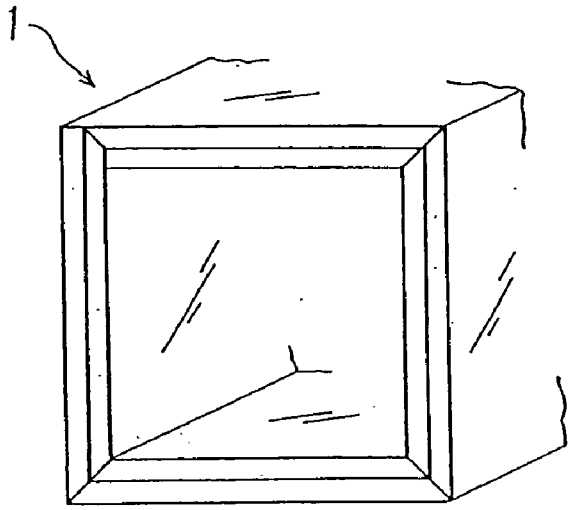
FIG. 9 is a perspective view of a beam.

The beams 1 are required to have strength, rigidity, water resistance and humidity resistance. Thus, as shown in FIG. 9, there may be desirably used the beams in the form of square hollow body, which may be formed by winding and adhering paperboard material treated for water resistance and for water repellency in a square-spiral manner so as to form a few winding layers. The paperboard material has the maximum thickness of 7 mm for allowing the V-cut grooves to be formed for bending it in a square manner. If the paperboard material has the thickness of more than 7 mm, the V-cut grooves could not be formed and therefore the thickness of the paperboard material should have the thickness of 7 mm or less enabling the V-cut grooves to be formed whereby the paperboard material is allowed to be bended in a spiral manner until it has the predetermined thickness so as to have the high strength and the rigidity. The beams 1 in the form of square hollow body formed by winding and adhering the paperboard material until it reaches a plurality of layers has the rigidity, which the cured adhesive layers disposed between the plurality of paperboard layers impart to the beams 1 in a manner similar to the dense growth rings of the tree formed during the winter season. Therefore, even if the paperboard material might be thin, the beams 1 can have the lightweight, the strength and the rigidity maintained by means of the plurality of paperboard layers and the adhesive layers.

Figure 10:
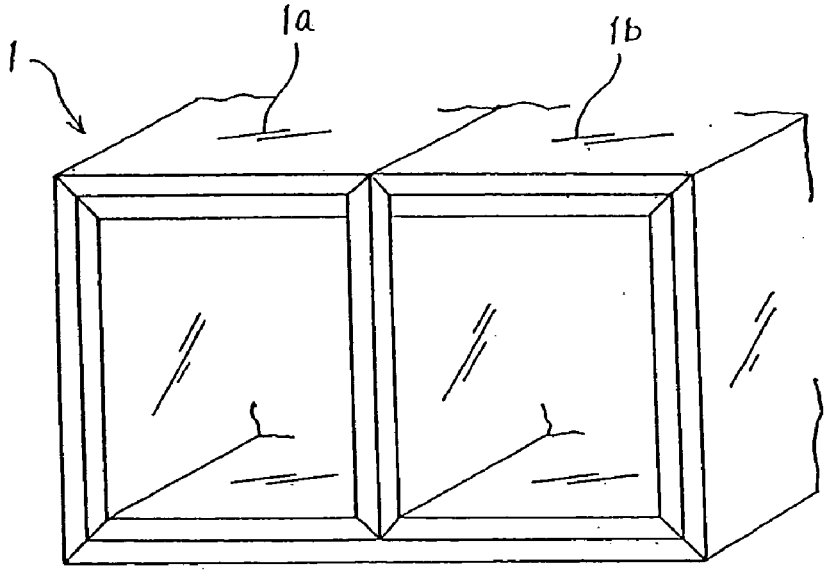
FIG. 10 is a perspective view of a beam constructed in another form.
Figure 11:
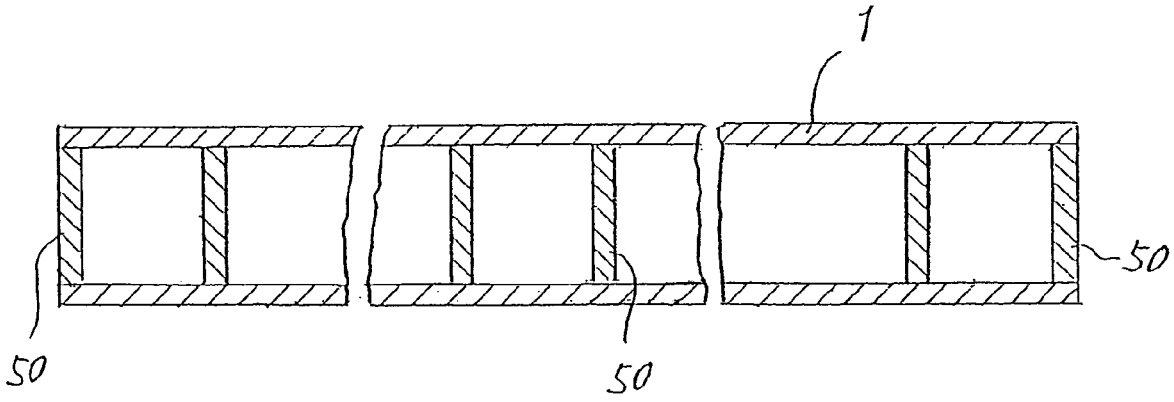
FIG. 11 is a cross sectional view of a beam constructed in further form.

In addition thereto, as shown in FIG. 10, the square-spiral beams 1 may comprise two square hollow bodies 1*a* and 1*b* disposed in parallel to each other in right and left sides. The two square hollow bodies 1*a* and 1*b* may be manufactured so as to form the square-spiral bodies in a manner substantially similar to that in which the square-spiral beams 1 formed of the single square hollow body shown in FIG. 7 is manufactured. As shown in FIG. 11, the beams 1 may be manufactured so that square hollow bodies 50 shown in FIG. 12 may be inserted and adhered at some places such as both ends and approximately center portions within the space of the beams 1 whereby the strength and the rigidity imparted to the beams can be improved. In this case, the square hollow bodies 50 serve to support and absorb a load applied to the hollow beams 1. This prevents the beams 1 from being buckled and deformed due to the load of the cargoes mounted on the top board whereby the flat state of the top board can be maintained so that the cargoes mounted on the top board can be maintained in a stable state.

The paperboard material used for forming the beams 1, the inner core material of the strip-like board 2 and the bended edge members 4 for the pallet of the invention may be desirably formed of laminate board material such as solid ones having elasticity and toughness. Using the solid laminate board causes the pallet to have the reduced weight and the easy treatment when an operator conveys it and also to be hardly broken. This allows about ten repetitive use of the pallet and therefore one time use cost can decrease sharply and gets relatively inexpensive. In addition thereto, recovery of the pallets can be easier and recycling of them is possible, which causes the pallets to finally become paper manufacture materials. Thus, it will be noted that the pallets of the invention can get ecologically gentle for earth environment.

With the inner core material 8 of solid board for the strip-like board covered all over the surfaces with the tough pattern paper layer 9, there can be provided small width boards having bend-resisting strength. With the pattern paper layer 9 on its surface treated by coating for water resistance and for water repellency, and with the end face of the strip-like board 2 along the longitudinal direction treated by coating agent for water resistance and for water repellency, the strip-like boards 2 can have the enough durability maintained even when the pallet is used not only in watering places, but also in high humidity atmosphere in rainy season or the like. The tough small width boards for the strip-like boards 2 can be obtained with the thickness of the board as much as 70% of the thickness of the wood.

With the surrounding portions of the fork insertion openings 5 having three layers comprising the two layers 4*a* and the inner core material 4*b* disposed between the two layers 4*a*, the load can be avoided from being concentrated at the opening upper edges of the fork insertion openings 5 when the pallet is supported while it is lifted and lowered with the forks inserted into the fork insertion openings 5. This causes the opening upper edge of the fork insertion openings 5 from being deformed and broken and therefore the portions surrounding the fork insertion openings 5 can have the strength, the rigidity and the durability maintained.

Figure 14:
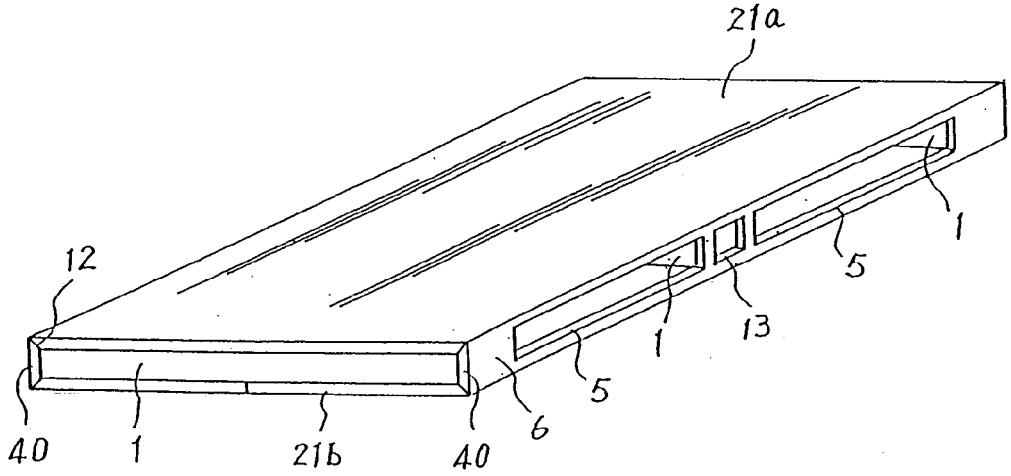
FIG. 14 is perspective view of a cargo loading and unloading pallet having flat top and back faces provided.

Furthermore, in case where the bended edge members 4 for the cargo loading and unloading pallet 10 of drainboard shape has the single layer of paperboard material, a reinforcement member 7 in the form of rectangular frame corresponding to the shape of the fork insertion openings 5 as shown in FIG. 14 may be adhered to upper and lower inner faces of the bended edge member 4 to thereby reinforce the portion adjacent to the fork insertion openings 5 whereby the strength and the rigidity of the portion where the fork insertion openings 5 are located is maintained.

(Embodiment 2)

Figure 13:
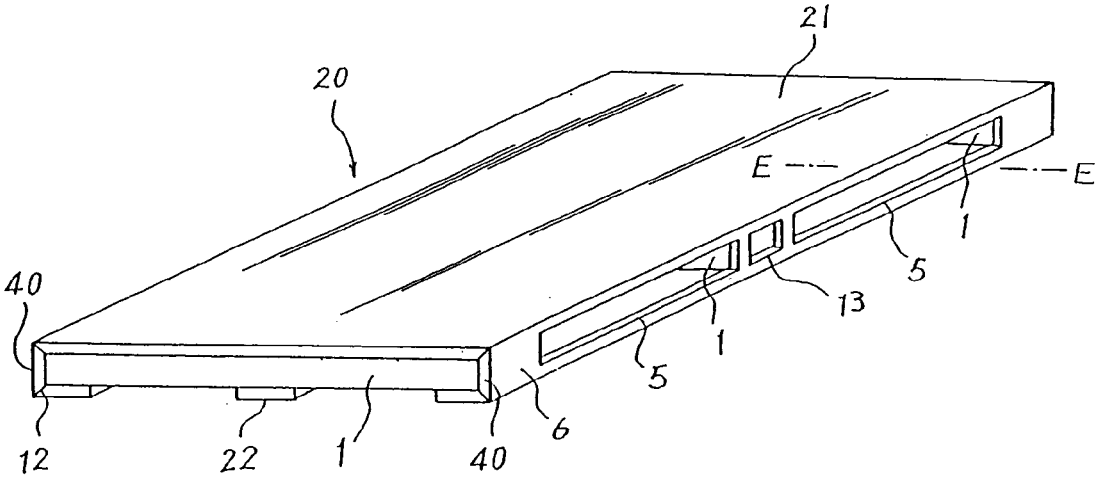
FIG. 13 is perspective view of a cargo loading and unloading pallet having a flat top face provided.

The Embodiment 1 relates to the cargo loading and unloading pallet 10 is in the form of drainboard, but the Embodiment 2 relates to the cargo loading and unloading pallet having what is called flat boards (top flat board and lower flat board). In FIG. 13 a reference numeral 20 designates a cargo loading and unloading pallet having a top flat board provided and a reference numeral 21 designates the top flat board of paperboard material. The top flat board 21 has channel-shaped elongated bend portions 40 formed in a lateral direction and faced to each other in the two sides of the square paperboard material. A pair of fork insertion openings 5 are provided in the vertical walls 6 of the bend portions 40 of the top flat board 21. A reference numeral 1 designates beams of square hollow body of paperboard material, which is identical to that of the embodiment 1. These beams 1 are displaced at places where there are not located the pair of forks insertion openings 5 in a spaced manner along the longitudinal direction so as to be perpendicular to the bend portions 40 and adhered to the inner face of the top flat board 2l and the bend portion 40 thereof while it is inserted into the bend portions 40. Thus, it will be noted that the beams 1 and the bend portions 40 form a reinforcement member where they cross each other in a X-Y direction on a plane of the top flat board 21. Strip-like reinforcement boards may be adhered to all the beams 1 at a center of an inner face opposite to the top flat board 21. There may be provided in the bend portions 40 openings 13 through which a cargo binding band can extend.

Figure 12:
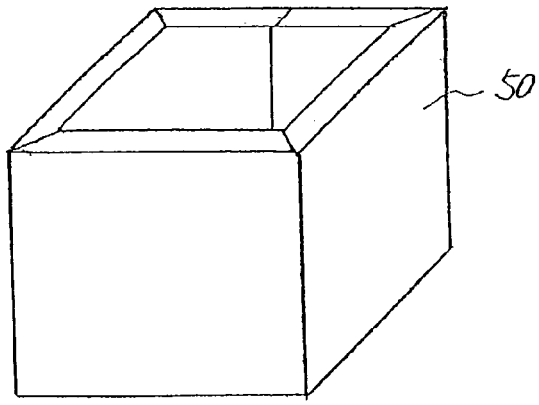
FIG. 12 is a perspective view of a square hollow body used for the beam of FIG. 11.

FIG. 14 illustrates a modification of the cargo loading and unloading pallet 20 having the top flat board. The cargo loading and unloading pallet 20 having the top flat board as shown in FIG. 11 may be opened in its bottom face or have the strip-like reinforcement board 22 provided over all the beams 1 on the bottom face while the cargo loading and unloading pallet 20 having the top flat board as shown in FIG. 12 comprises a top board 21*a* of paper material having the elongated channel-shaped bend portions 40 formed and faced to each other in two sides of the square, a bottom board 21*b* following the bend portions 40 and beams 1 of square hollow body of paperboard material inserted into the bend portions 40 in a manner perpendicular to the longitudinal direction of the bend portions 40 and adhered to the inner faces of the top board 21*a* and the bottom board 21*b* and the bend portions 40. Since the pallet has all the top and bottom faces formed by the top board 21*a* and the bottom board 21*b*, the top board 21*a*, the bottom board 21*b* and the beams 1 form a cross-like reinforcement member extending in a X-Y direction on a plane of the pallet, have the X-Y direction strength and rigidity in the plane of the pallet and have no twist imparted in the X-Y direction in the plane whereby there can be obtained the flat compact pallet having lightweight and toughness. Both of the top and bottom faces of the pallet may be used for mounting the cargoes by inverting the top and bottom faces of the pallet whereby the reversible pallet can be provided, which can be conveniently and economically used.

Figure 15:
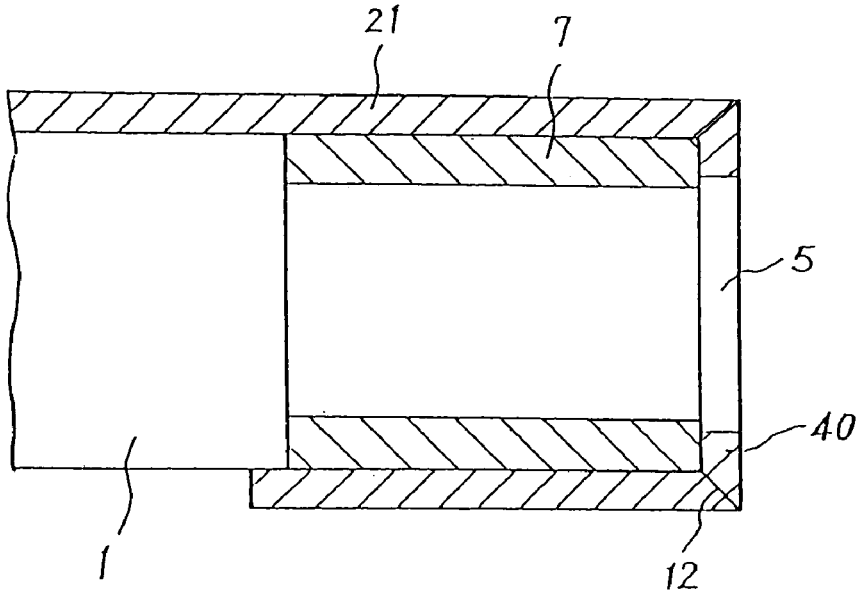
FIG. 15 is a cross sectional view of the pallet taken along a line E—E of FIG. 13.
Figure 16:
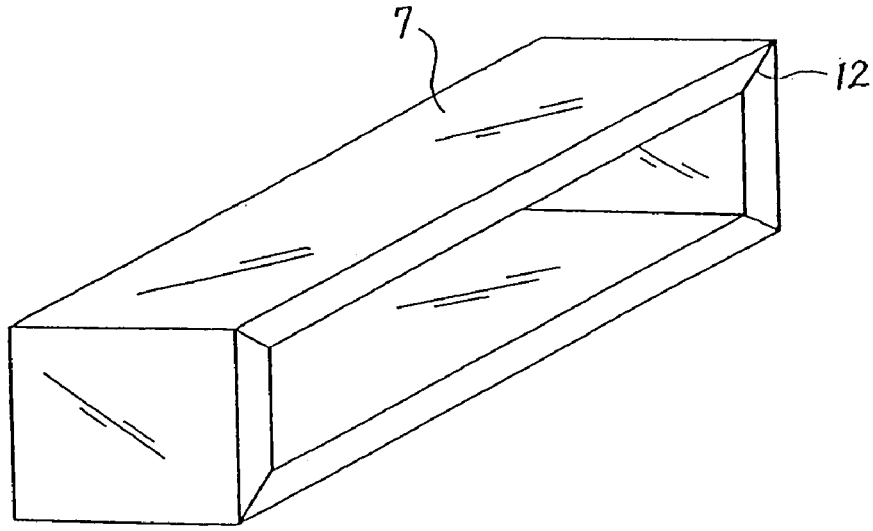
FIG. 16 is a perspective view of a frame-like reinforcement member.

In the cargo loading and unloading pallet having the flat top board provided thereon as shown in FIGS. 11 and 12, the portion where the pair of fork insertion openings 5 are provided may have the frame-like reinforcement member 7 of rectangular shape corresponding to that of the fork insertion openings 5 as shown in FIG. 16 adhered to the portion where the pair of fork insertion openings are provided and the back face of the top board 1, which is illustrated in FIG. 15 to thereby impart to the opening portion the strength and the rigidity on bringing it up and down while the forks are inserted into the openings.

With the cargo loading and unloading pallet in the form of drainboard as shown in Example 1, since the strip-like boards 2 for drainboard have the inner core material 8 of thick paper board such as solid board and the pattern paper 9 treated for water resistance and for water repellency and which the inner core material 8 is covered with and adhered to all over the front and back faces thereof periphery while the end faces of the strip-like boards 2 are treated by painting for water resistance and for water repellency, the strip-like boards 2 for drainboard can have the lightweight and the toughness imparting the strength and the rigidity. Furthermore, they are supported by the plurality of beams 1 at predetermined distance whereby they can serve to mount the weighty cargoes without being bended and folded. Also, since the beams 1 and the bended edge members 4 are treated for water resistance and for water repellency, the pallet can be used in water places or in high humidity atmosphere such as in rainy season while high durability can be maintained.

Also, the cargo loading and unloading pallet having the flat top board provided in Example 2 can have the lightweight, the strength, the rigidity, the water resistance and the humidity resistance and therefore can be used in water places or in high humidity atmosphere such as in rainy season while high durability can be maintained.

In addition thereto, with the cargo loading and unloading pallet 10 in the form of drainboard as shown in Example 1, since the bended edge members 4 having the fork insertion openings 5 provided therein have the strength and the rigidity maintained by two or three layers of paperboard bended and superposed one upon another in the upper and lower faces thereof or by the frame-like reinforcement member 7 of rectangular shape corresponding to the shape of the fork insertion openings 5 and adhered to the single layer bended edge members 4, the load can be avoided from being focused on the upper edge of the fork insertion openings 5 when the forks are inserted into the openings to thereby bring up or down the pallet, which prevents the upper edge of the fork insertion openings 5 from being deformed or damaged whereby the durability of the pallet can be held.

In the cargo loading and unloading pallet 20 having the flap top board provided thereon in Example 2, the portions of the bended parts 40 formed of the single top board 21 or of the top and bottom boards 21*a* and 21*b* where the fork insertion openings 5 are provided therein are reinforced by the frame-like reinforcement member 7 of rectangular shape corresponding to the fork insertion openings 5, the upper edge of the fork insertion openings 5 can be also prevented from being deformed or damaged whereby the durability of the pallet can be held.

Since all the beams 1, the bended edge members 4 and the bended portions of the top board 21 or the top and bottom boards 21*a* and 21*b* at the bended locations are formed by the V-cut grooves 12 provided therein, the sharpened bend can be accomplished whereby the products having the good appearance and quality can be obtained. Furthermore, since the fork insertion openings 5 can be formed by using edged tools as in punching, there are not at all produced fins at cut faces or slit faces thereof. This causes the pallet to have the distinguishable treatment in view of safety and all the properties of productivity, mass-productivity and the economical efficiency, which enables a stable supply of the pallet having lower cost.

(Embodiment 3)

Figure 21:
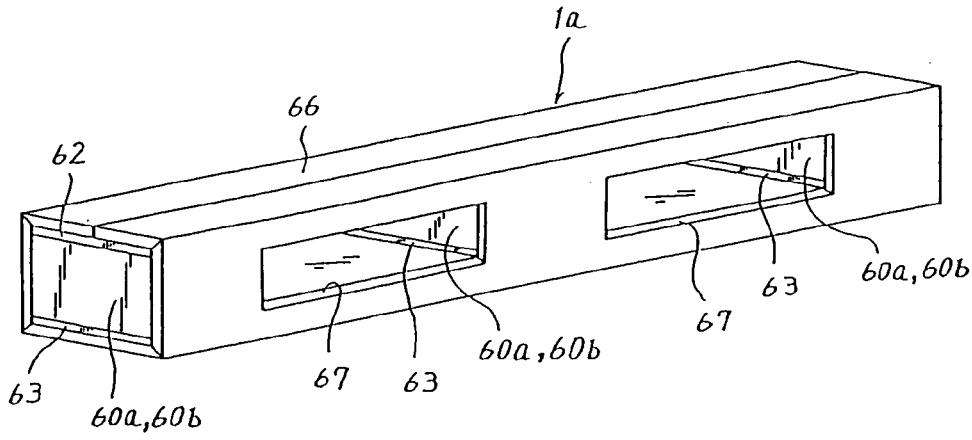
FIG. 21 is a perspective view of a beam according to another form.
Figure 22:
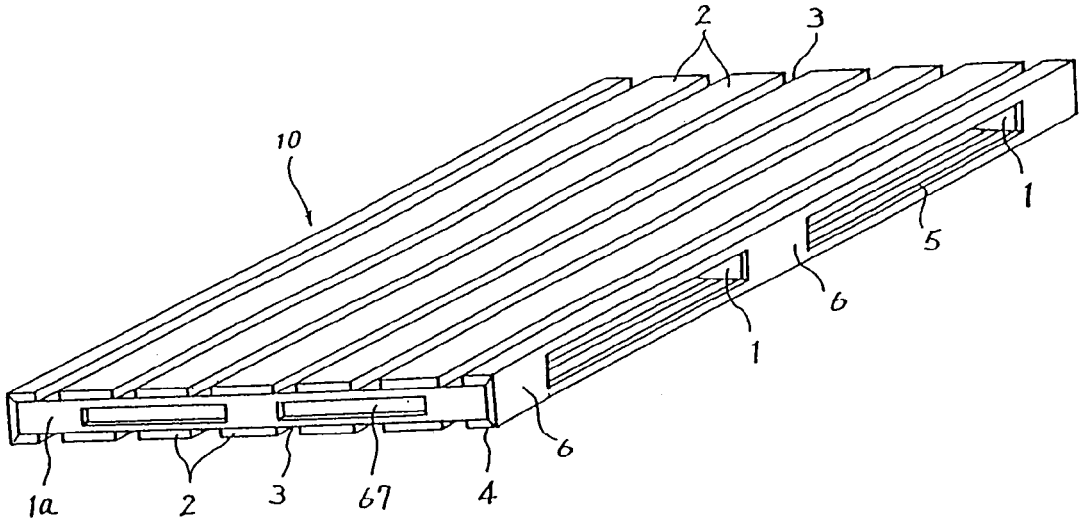
FIG. 22 is a perspective view of a cargo loading and unloading pallet having a beam according to another form used.

FIGS. 17 through 23 show Embodiment 3 of the invention. As shown in FIG. 22, the pallet 10 of Example 3 has the form similar to that of the pallet shown in FIG. 1, but the beams 1 may be characterized in that they are so adapted to have an improvement on the productivity, the pressure resistance, the strength of buckling resistance and the rigidity and to enable four way insertion of the fork of the forklift truck or the stacker in rightward or leftward directions in addition to the two way insertion thereof. The detailed construction thereof will be described hereinafter. Each of members described below is of paper board.

Figure 17:
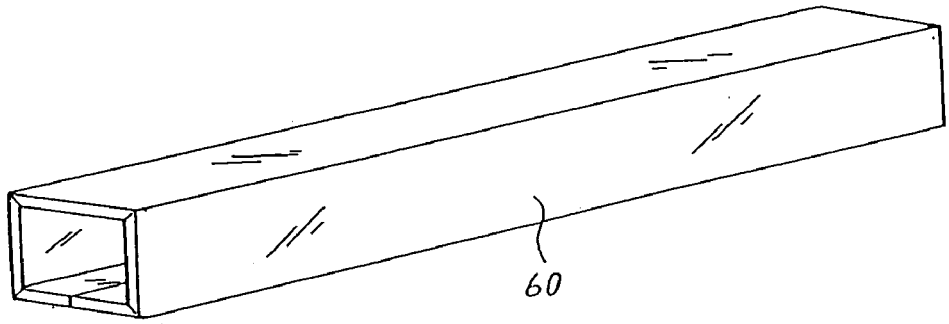
FIG. 17 is a perspective view of a square hollow body for a beam according to another form.

FIG. 17 shows an elongated square hollow body 60 to form square poles 60*a* and 60*b* of the beams 1*a*. The square hollow body 60 may be opened at both ends thereof.

Figure 18:
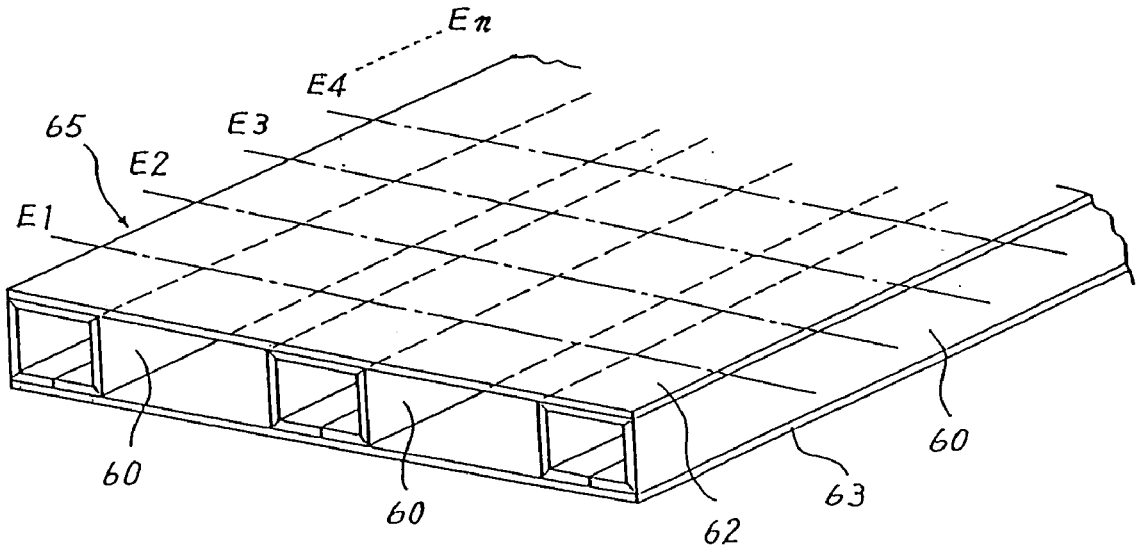
FIG. 18 illustrates how to assemble a frame according to another form.
Figure 19:
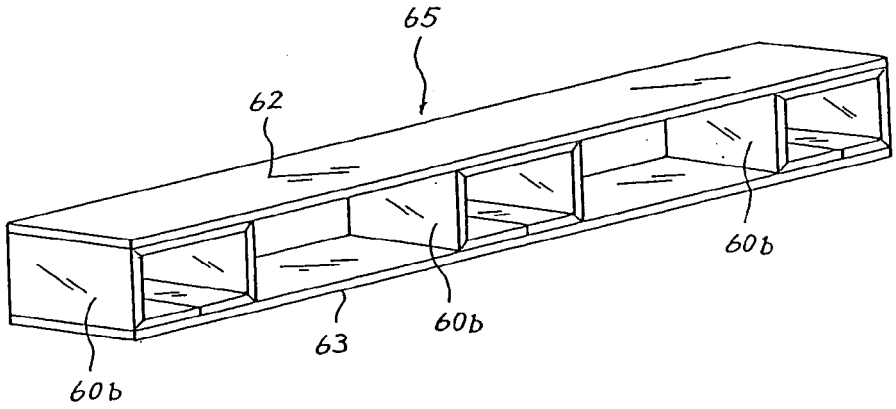
FIG. 19 is a perspective view of a beam frame.
Figure 20:
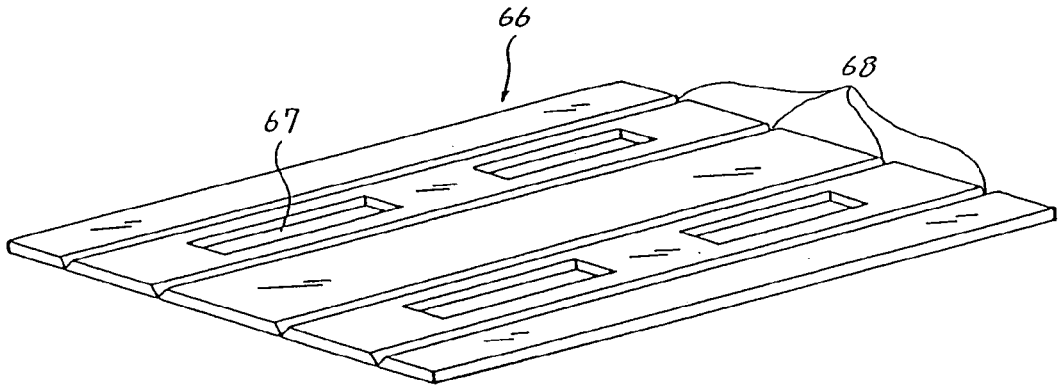
FIG. 20 is a perspective view of an outer board surrounding the beam frame.

FIG. 18 illustrates an example of producing a beam framework 65 shown in FIG. 19 at high productivity with the square hollow body 60 used. A plurality of square hollow bodies 60 are disposed in parallel at predetermined distance, an upper flat board 62 and a lower flat board 63 are adhered to the upper and lower faces of the square hollow bodies 60 and the thus formed assembly is cut along lines E1 through E4, - - - En at predetermined distance in a direction perpendicular to the longitudinal direction of the square hollow bodies 60 whereby many beam frameworks 65 can be produced efficiently and shortly.

The thus produced beam framework 65 has the strip-like boards formed by the upper and lower flat boards 62 and 63 cut along the lines E1 through E4, - - - En and the square hollow bodies 60 get the plurality of square poles 60*a* and 60*b* spaced at predetermined distance between the strip-like boards.

The beam 1*a* can be formed by surrounding the thus produced beam framework 65 with an outer board 66, which is adhered to the framework 65. The outer board 66 is bended along V-shaped cut grooves 68 in a flat board having an area enough to surround the four side faces of the beam framework 65. In the cargo loading and unloading pallet shown in FIG. 22, the outer board 66 may be provided with fork insertion openings 67 formed by punching or the like at places corresponding to the beams located at both ends of the pallet in order to be able to insert the fork into the pallet in four ways. The thus outer board 66 surrounds the beam framework 65 to thereby produce the complete beam 1*a* having the fork insertion openings 67 provided as shown in FIG. 21. Since the beams located at middle portions of the cargo loading and unloading pallet 10 are not required to have the fork insertion openings 67, the outer board 66 has no openings provided at the corresponding portions surrounding the beam framework. In case where the pallet 10 is of two way insertion type, the outer board 66 is not required to have any fork insertion openings provided therein.

The cargo loading and unloading pallet shown in FIG. 22 may be produced by using the beams 1*a* having the aforementioned construction. The description of the whole construction of the cargo loading and unloading pallet 20 according to the Example 2 shown in FIG. 22 will be omitted because the components other than the beams 1*a* are identical to those of the cargo loading and unloading pallet of FIG. 1.

In the Embodiment 3, the beam frameworks 65 can be very effectively mass-produced as shown in FIG. 18 and therefore the cost of the pallet can be reduced. In addition thereto, there can be provided the cargo loading and unloading pallet 10 having the reduced weight and the strength of pressure resistance and buckling resistance and the rigidity improved by covering the beam frameworks 65 with the outer boards 66 and integrally adhering both of them to each other.

The pallets have such an advantage as the portions where the fork insertion openings 67 are provided are not required to have any reinforcement material applied thereto because of the beams 1*a* themselves having the high strength and the high rigidity and the square pole bodies 60*a* and 60*b* will not be displaced from the predetermined location even though the forks are inserted into the fork insertion openings 67 and engaged with the square pole bodies 60*a* and 60*b* because they are held between the upper and lower strip-like boards 62 and 63 and covered with the outer boards 66.

Figure 23:
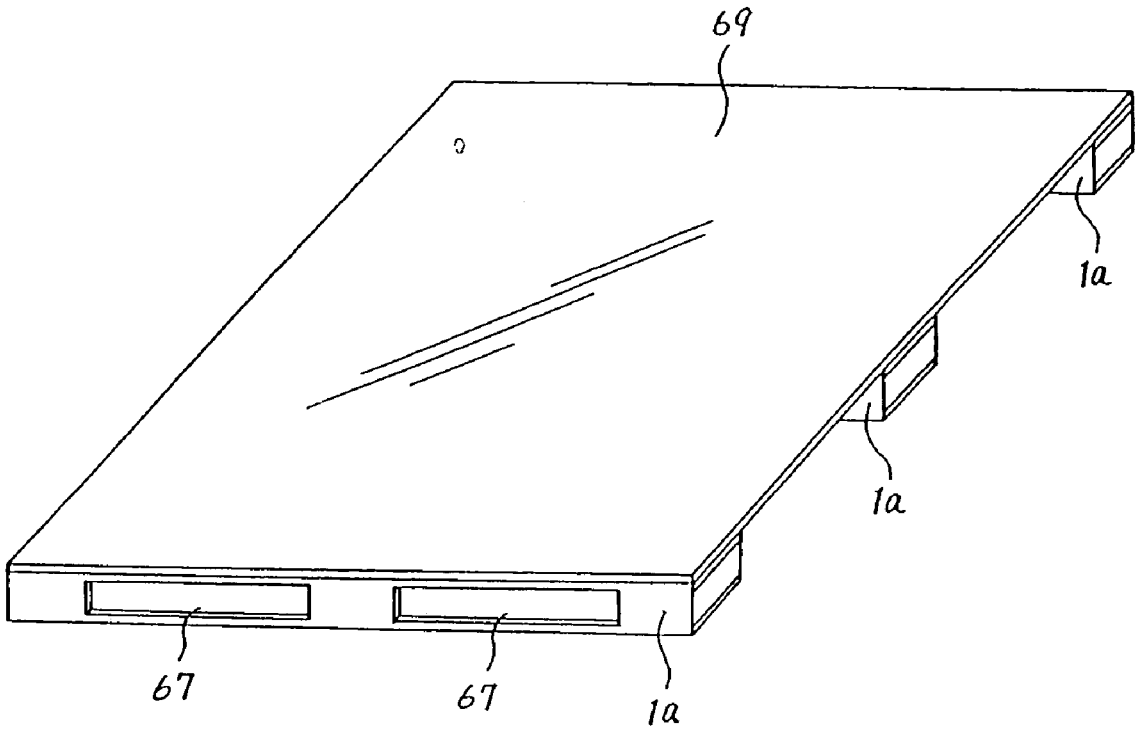
FIG. 23 is a perspective view of a cargo loading and unloading pallet constructed in a modified form.

In FIG. 23, a reference numeral 69 designates a modified cargo loading and unloading pallet having the aforementioned beams 1*a*. The modified cargo loading and unloading pallet 69 has such a simple construction as it has only a top board adhered to the plurality of beams 1*a* disposed. Thus, there can be provided the cargo loading and unloading pallet 69 having the lower weight and the much improved strength of pressure resistance and buckling resistance and the rigidity.

Since the pallets according to the Examples 1 through 3 of the invention are lightweight and compact, they can be more easily carried and many pallets can be stably superposed one upon another within a defined space when they are not used for cargo loading and contained for being kept. Especially, the transportation expense for reciprocally being used (in a returnable manner) is advantageously reduced. The pallets of the invention can be used not only for cargo loading operation, but also for keeping cargoes in a warehouse as serving as a cargo mount base. They are also used as a shelf.

UTILIZABILITY FOR INDUSTRIES

According to the invention, there can be provided the pallet formed from a small amount of paperboard material and is compact and lightweight, and has the high strength and rigidity, toughness, durability, weather-proof, which makes them hardly broken, easily recovered, able to be recycled so as to be recovered to paper material and ecologically gentle to earth environment. The invention can advantageously prevent the fork insertion portions from being deformed or damaged because the difficulty of shortage of the strength and the rigidity of the fork insertion opening portion caused by the prior paperboard pallet can be solved by the reinforcement treatment according to the specified construction of the invention. Furthermore, Since the pallet is thin and compact, many pallets can be stably superposed one on another within a defined space to thereby contain and keep them or convey them by a track. Especially, the transportation expense can be advantageously reduced when the pallets are reciprocally used (in a returnable manner) on the cargo loading operation, which cannot be accomplished by the prior resin, wooden or metal pallet.

What is claimed is:

1. A cargo loading and unloading pallet comprising a framework having a pair of channel-shaped elongated bended edge members of paperboard material faced to each other and a plurality of beams of square hollow body of paperboard material treated for water resistance and water repellency, said beams having longitudinally spaced ends engaged with said bended edge members in a manner perpendicular to a longitudinal direction of said bended edge members and placed in parallel to each other in a manner spaced at predetermined distance whereby forks can be inserted between them, and strip-like boards placed in parallel to each other on both or either of front and back faces of said beams with a gap provided between adjacent strip-like boards in a direction perpendicular to a longitudinal direction of said beams and adhered to said beams, each of said strip-like boards formed of an inner core member of thick paperboard and a pattern paper treated for water resistance and for water repellency and covering all the periphery of front and back faces of said inner core member, and each of said strip-like boards being treated with a coating agent for water resistance and for water repellency, and said bended edge members having a pair of fork insertion openings provided in a vertical wall face thereof and having paperboard layers bended and superposed so as to reinforce upper and lower faces of portions where said fork insertion openings are provided.

2. A cargo loading and unloading pallet comprising a framework having a pair of channel-shaped elongated bended edge members of paperboard material faced to each other and a plurality of beams of square hollow body of paperboard material treated for water resistance and for water repellency, said beams having longitudinally spaced ends engaged with said bended edge members in a manner perpendicular to a longitudinal direction of said bended edge members and placed in parallel to each other in a manner spaced at predetermined distance whereby forks can be inserted between them, and strip-like boards placed in parallel to each other on both or either of front and back faces of said beams with a gap provided between adjacent strip-like boards in a direction perpendicular to a longitudinal direction of said beams and adhered to said beams, each of said strip-like boards formed of an inner core member of thick paperboard and a pattern paper treated for water resistance and water repellency and covering all the periphery of front and back faces of said inner core member, and each of said strip-like boards being treated with a coating agent for water resistance and water repellency, said bended edge members having a pair of fork insertion openings provided in a vertical wall face thereof and having a reinforcement member of paperboard adhered to upper and lower faces of said bended edge members to reinforce upper and lower faces of portions where said fork insertion openings are provided.

3. A cargo loading and unloading pallet comprising a framework having a pair of channel-shaped elongated bended edge members of paperboard material faced to each other and a plurality of beams of paperboard material treated for water resistance and for water repellency, said beams having longitudinally spaced ends engaged with said bended edge members in a manner perpendicular to a longitudinal direction of said bended edge members and placed in parallel to each other in a manner spaced at predetermined distance whereby forks can be inserted between them, each of said beams having a framework formed by a plurality of elongated square hollow bodies placed in parallel to each other at a predetermined distance and flat boards of paper board material adhered to upper and lower faces of said square hollow bodies, said beam further having an outer board of paperboard with which said framework is covered on four faces of the periphery thereof, and said pallet further comprising a flat board or boards adhered to both or either of front and back faces of said beams so as to form a top board, a bottom board or a top board and a bottom board.

4. A cargo loading and unloading pallet as set forth in claim 3, wherein said outer board surrounding said beam framework has fork insertion openings provided therein for a forklift truck or a stacker.

5. A cargo loading and unloading pallet as set forth in claim 3, wherein said bottom board extends between said channel-shaped elongated bended edge members and remote from said top board.

* * * * *

UNITED STATES PATENT AND TRADEMARK OFFICE

CERTIFICATE OF CORRECTION

PATENT NO. : 6,997,112 B2
APPLICATION NO. : 10/495179
DATED : February 14, 2006
INVENTOR(S) : Hideaki Nishizaki et al.

It is certified that error appears in the above-identified patent and that said Letters Patent is hereby corrected as shown below:

On Title Page, col. 1 of the patent, Item (22) PCT Filed: should read:

--Oct. 11, 2002--.

Signed and Sealed this

Fifteenth Day of August, 2006

JON W. DUDAS
*Director of the United States Patent and Trademark Office*